US011808432B1

(12) United States Patent
Chen

(10) Patent No.: US 11,808,432 B1
(45) Date of Patent: Nov. 7, 2023

(54) LED MODULE TRACK LIGHTING SYSTEM

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 18/191,069

(22) Filed: Mar. 28, 2023

Related U.S. Application Data

(60) Provisional application No. 63/332,317, filed on Apr. 19, 2022.

(51) Int. Cl.
*F21S 8/00* (2006.01)
*F21V 21/005* (2006.01)
*F21Y 115/10* (2016.01)

(52) U.S. Cl.
CPC ..... *F21S 8/038* (2013.01); *F21V 21/005* (2013.01); *F21Y 2115/10* (2016.08)

(58) Field of Classification Search
CPC ..... F21S 8/038; F21V 21/005; F21Y 2115/10
See application file for complete search history.

(56) References Cited

U.S. PATENT DOCUMENTS

2016/0018092 A1* 1/2016 Knaapen ..... F21V 23/06 362/249.02
2016/0033098 A1* 2/2016 Bergman ..... F21V 29/70 362/418
2016/0033099 A1* 2/2016 Bergman ..... F21S 2/005 362/236

* cited by examiner

*Primary Examiner* — Mary Ellen Bowman
(74) *Attorney, Agent, or Firm* — Stuart M. Goldstein

(57) ABSTRACT

An LED track lighting system has an elongated track with a central member extending the length of the track and positive and negative contact strips affixed to opposite sides of the central member. One or more LED modules are provided which support at least one LED lamp. The modules are formed as modified, inverted U-shapes having side walls extending down from a top wall. Positive and negative electrical contacts are affixed to the side walls. An electrical power source is connected to the contact strips for supplying electricity to the strips. Each LED module overlaps the central member and the module contacts such that the contacts come into contact with the contact strips. Electricity from the power source is transmitted to the contact strips, to the contacts, and then to the LED lamps to illuminate the lamps on the modules.

3 Claims, 2 Drawing Sheets

LED MODULE TRACK LIGHTING SYSTEM

RELATED APPLICATION

This application claims the benefit of provisional application Ser. No. 63/332,317 filed on Apr. 19, 2022.

FIELD OF THE INVENTION

The present invention relates to the illumination of LED modules by means of an electrical track lighting system.

BACKGROUND OF THE INVENTION

Track lighting is commonly used in commercial and residential settings to illuminate a variety of electrical lighting head fixtures, including, but not limited to, spot, bullet, monopoint, and radiant lighting heads. Such track lighting systems provide a measure of versatility for both functional and decorative lighting which utilize these fixtures.

However, there are currently no practical, effective, easy to install, versatile track lighting systems for illuminating LED modules, also employed for a variety of lighting purposes, especially for decorative and signage lighting.

SUMMARY OF THE INVENTION

It is thus the object of the present invention to provide a track lighting system, specifically designed for providing electricity to illuminate LED modules and thus allow simplicity in installation and flexibility in the use and positioning of LED modules in decorative and signage lighting.

This and other objects are accomplished by the present invention, an LED module track lighting system having an elongated track comprising a central member extending the length of the track and positive and negative contact strips affixed to opposite sides of and extending the length of the central member. One or more LED modules are provided, each module having a top wall which supports at least one LED lamp. The modules are formed as modified, inverted U-shapes having first and second side walls extending down from the top wall. Positive and negative electrical contacts are affixed to the inner surfaces of the side walls. An electrical power source is connected to the contact strips for supplying electricity to the strips. Each LED module overlaps the central member and the module contacts such that the contacts come into contact with the contact strips. This results in electricity from the power source being transmitted to the contact strips, to the contacts, and then to the LED lamps to illuminate the lamps on the modules.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
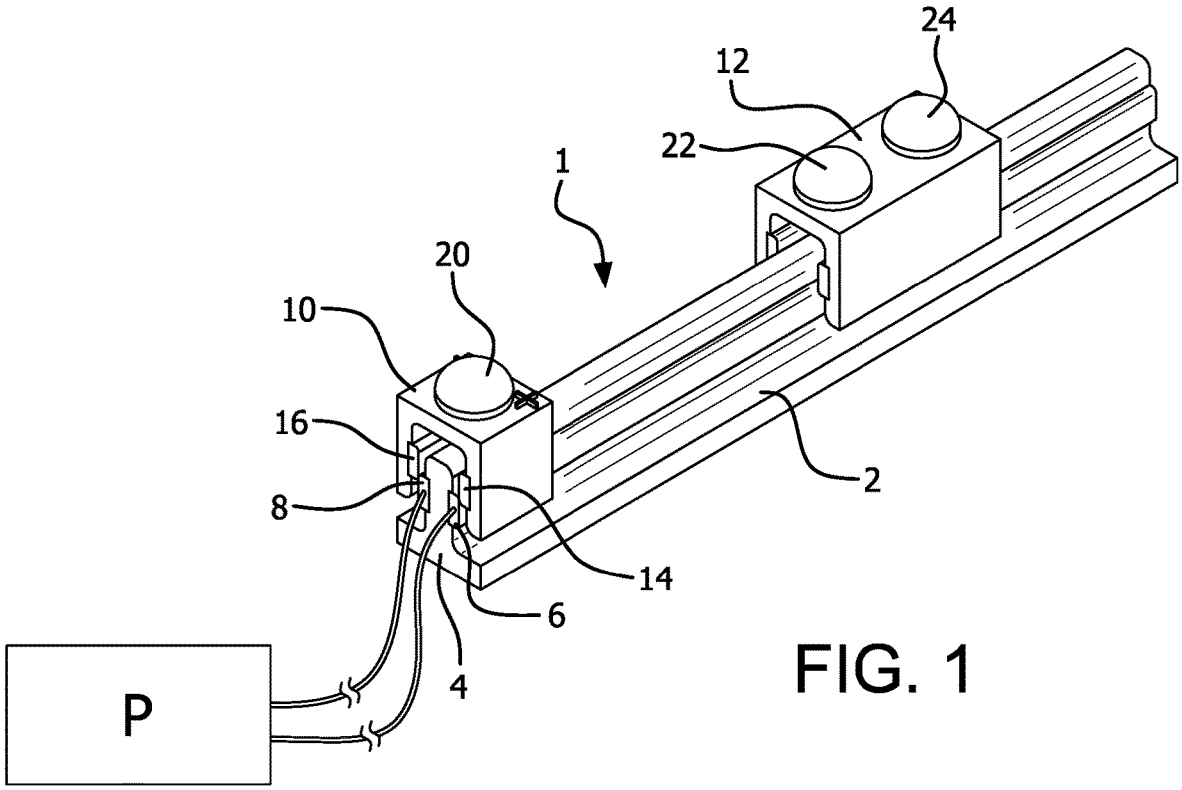
FIG. 1 is a perspective view of the track lighting system of the present invention on which LED modules are mounted.

LED module track lighting system 1 of the present invention comprises elongated track 2 having elongated central member 4 which extends the length of the track. Elongated, positive electrical contact strip 6 is affixed to one side of central member 4 and extends the length of the central member. Elongated, negative electrical contact strip 8 is affixed to the opposite side of central member 4 and also extends the length of the central member. Electricity is supplied to contact strips 6 and 8 via an electrical power source P connected to the contact strips.

Each of the LED modules 10 and 12 takes the form of a modified, inverted "U." Specifically with regard to module 10, side wall 11 having inner surface 13 and side wall 15 having inner surface 17 extend down from top wall 19. LED lamp 20 is supported by top wall 19. Positive electric contact 14 is affixed to inner surface 17 of side wall 15 and negative electric contact 16 is affixed to side wall 11. Contacts 14 and 16 are connected by standard electrical wiring (not shown) to LED lamp 20. Module 12 is identical to module 10, except its top wall supports two LED lamps 22 and 24.

Figure 2:
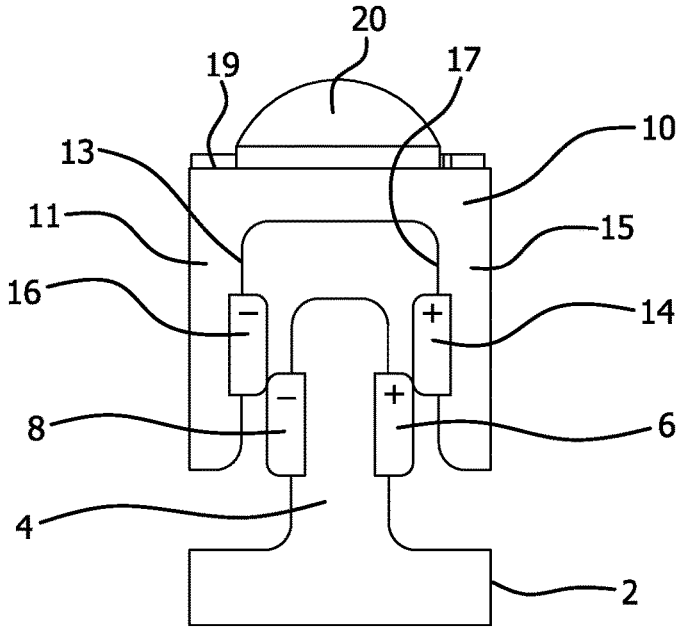
FIG. 2 is an end view of the embodiment in FIG. 1 illustrating the positioning of an LED module on the track lighting system of the present invention.
Figure 3:
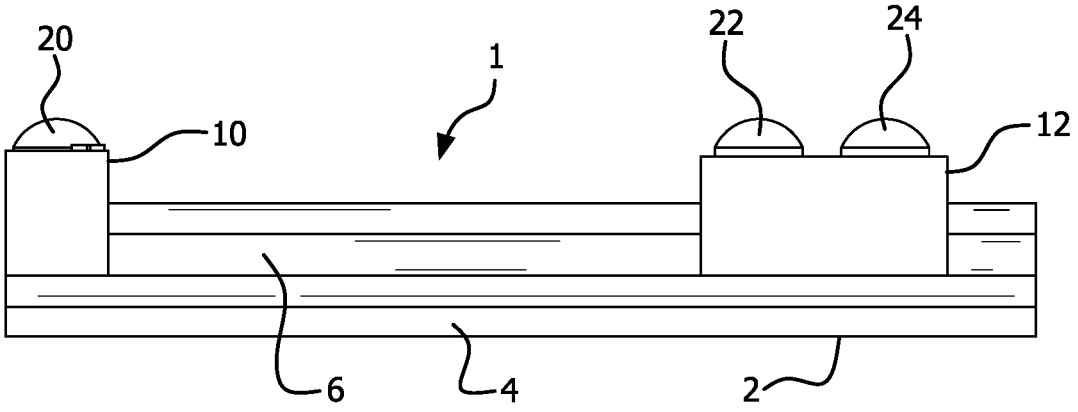
FIG. 3 is an elevation view of the embodiment in FIG. 1 illustrating the positioning of LED modules on the track lighting system of the present invention.
Figure 4:
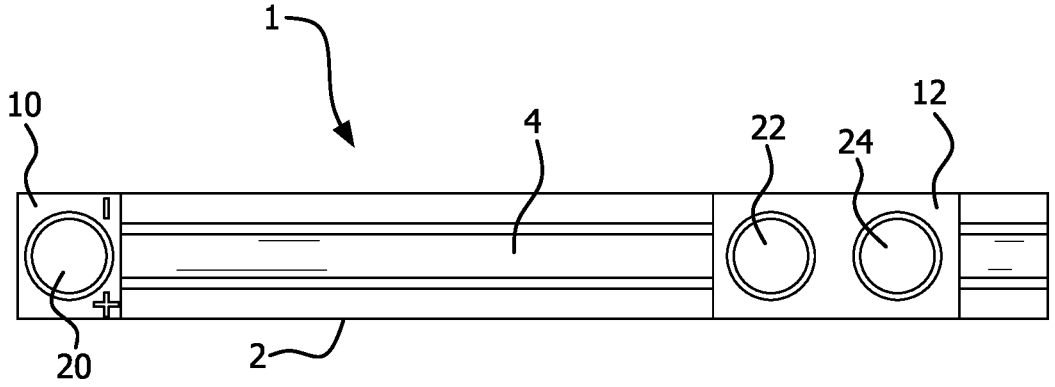
FIG. 4 is a top view of the track lighting system of the present invention illustrating the positioning of LED modules on the track lighting system of the present invention.

LED modules 10 and 12 are configured overlap central member 4 of track 2. As best seen in FIG. 2, positive electrical contact 14 of module 10 is positioned over central member 4 such that it contacts positive electrical contact strip 6 and negative electrical contact 16 of module 10 is positioned such that it is in contact with negative electrical contact strip 8. Likewise, the positive and negative contacts of module 12 are positioned over central member 4 such that the electrical contacts come into contact with contact strips 6 and 8.

By the track lighting system 1 of the present invention, electricity is provided by power source P to contact strips 6 and 8 of the track lighting system, which in turn transmit this electricity via contacts 14 and 16 of LED module 10 to illuminate LED lamp 20 and lamps 22 and 24 on LED module 12.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An LED module track lighting system comprising:

an elongated track comprising:

an elongated lower base supporting a single elongated central member upstanding from the base and extending the length of the track;

an elongated positive electrical contact strip affixed to one side of the central member and extending the length of the central number; and an elongated negative electrical contact strip affixed to the opposite side of the central member and extending the length of the central member;

at least one LED module comprising:

a top wall supporting at least one LED lamp;

first and second lateral side walls extending down from the top wall, the top wall and the side walls forming an inverted U shape, each lateral side wall having an inner surface;

a positive electrical contact affixed to the inner surface of the first lateral side wall and a negative electrical contact affixed to the inner surface of the second lateral side wall; and an electrical power source connected to the elongated positive and negative contact strips for supplying electricity to said strips; wherein the at least one LED module overlaps the central member and the contacts of said module come into contact with the contact strips, such that electricity from the power source is transmitted to the contact strips, to the contacts, and then to the LED lamps to illuminate the lamps.

2. The LED module track lighting system as in claim 1 wherein the at least one LED module is a modified, inverted U shape.

3. The LED module track lighting system as in claim 1 wherein multiple LED modules overlap the central member, each of the multiple modules having positive and negative contacts which come into contact with the contact strips, such that electricity from the power source is transmitted to the contact strips, to the contacts of the multiple LED modules, and then to LED lamps mounted on the modules to illuminate the lamps.

* * * * *